United States Patent [19]

Cosyns et al.

[11] 4,145,276

[45] Mar. 20, 1979

[54] PROCESS FOR THE 3-STEP CATALYTIC TREATMENT OF HIGHLY UNSATURATED HEAVY FRACTIONS UNDER HYDROGEN PRESSURE

[75] Inventors: Jean Cosyns, Maule; Jean-Pierre Franck, Bougival, both of France

[73] Assignee: Institut Francais du Petrole, Rueil-Malmaison, France

[21] Appl. No.: 862,324

[22] Filed: Dec. 20, 1977

[30] Foreign Application Priority Data

Jan. 5, 1976 [FR] France ..... 76 00202

[51] Int. Cl.[2] ..... C10G 23/04

[52] U.S. Cl. ..... 208/57; 208/143; 208/144; 252/458; 260/667

[58] Field of Search ..... 208/57, 143, 144; 260/667

[56] References Cited

U.S. PATENT DOCUMENTS

| | | | |
|---|---|---|---|
| 3,161,586 | 12/1964 | Watkins | 208/255 |
| 3,899,543 | 8/1975 | Cosyns et al. | 208/143 |
| 3,954,601 | 5/1976 | Cosyns et al. | 208/143 |

*Primary Examiner*—Herbert Levine

*Attorney, Agent, or Firm*—Millen & White

[57] ABSTRACT

An unstable heavy hydrocarbon fraction obtained by pyrosis is reacted with hydrogen in contact with three successive catalysts:

(a) a group VIII metal catalyst (b) a catalyst comprising nickel and tungsten compounds, and (c) a catalyst comprising alumina, a group VIII noble metal and fluorine or chlorine.

14 Claims, No Drawings

PROCESS FOR THE 3-STEP CATALYTIC TREATMENT OF HIGHLY UNSATURATED HEAVY FRACTIONS UNDER HYDROGEN PRESSURE

The present application is a continuation-in-part of our previous patent application Ser. No. 756,837 filed Jan. 5, 1977 and now abandoned.

The present invention relates to a process for the catalytic treatment, under hydrogen pressure, in three steps, of highly unsaturated heavy cuts, in order to produce carburants and/or fuels and/or petrochemical bases.

The charges to be treated are fractions whose boiling range at 76 cm Hg is at least in major part over the distillation range (for example in major part over 200° C.) of the gasolines obtained by pyrolyzing petroleum cuts, including visbreaking, coking and steam-cracking, or by pyrolyzing coal, lignites or bituminous shales. Their initial boiling point is usually above 150° C. Their final distillation point may be 350° C. or more.

These fractions have a very low content of saturated hydrocarbons, less than 20% by weight, for example 0 to 10% by weight, and a very high content of aromatic hydrocarbons, particularly alkylaromatic, polyaromatic, indenic and alkenylaromatic hydrocarbons, more than 80% by weight, for example 90 to 100% by weight.

The latter compounds are highly unstable and have a number of disadvantages: the pyrolysis products have usually a sulfur content of more than 0.01%, for example 0.05–2% by weight, they are unstable when stored, as a result of a strong tendency to form gums and polymers, which tendency makes even difficult the mere use of these fractions as fuel.

An object of this invention is to meet the difficulties of use of these fractions and provide for an appropriate multi-step catalytic treatment of said fractions under hydrogen pressure. At the end of these steps, a product is recovered whose saturated hydrocarbon content is higher than 80% b.w. and aromatic hydrocarbon content lower than 20% b.w., for example 1 to 10%.

A particular advantage of the present invention lies in the possibility of considerably increasing the ethylene yield of steam-cracking. It is known that the present trend in these processes is to treat heavier and heavier charges, for example gas-oil, which are less expensive than naphtha. However, in that case, the production of ethylene per metric ton of feed is lower, and it has been proposed to recycle the fractions boiling over 200° C. to the pyrolysis furnaces in order to increase that yield. Unhappily the essentially aromatic nature of these fractions makes them refractory to any further cracking treatment, so that this recycling is of no use. A particular object of the invention is to make this re-treatment possible.

The use of multi-step processes for stabilizing highly unsaturated distillates is widely known, but, up to now, the charges were mainly gasolines whose boiling range was in major part below 200° C. This type of process cannot be used when treating heavier charges, such as those treated in the invention. In that case, fast deactivation of the catalysts or insufficient hydrogenation of the aromatic hydrocarbons is observed.

Conventional hydrotreatment with conventional catalysts comprising group VIII metal sulfides associated with group IV A metal sulfides (periodic classification of the elements) cannot be economically used to treat this type of cut as a result of the very short cycles (for example, 1 to 3 months) attributable to a substantial polymerization in the catalyst bed, which may even necessitate the complete stopping of the reactor. This spoiling of the catalyst further results in the progressive deactivation thereof, which deactivation may be partially compensated by increasing the temperature of the catalyst bed; however the operating conditions become less and less favorable to hydrogenation, so that the desired hydrogenation rate can no longer be attained for thermodynamic reasons.

A process of this type is described, for example, in the U.S. Pat. No. 3,161,586. The object of the latter is to refine a full boiling range unsaturated distillate, i.e. a distillate comprising both a light fraction having a final boiling point of from 93° to 149° C. and a heavy fraction having an initial boiling point above 93° C. It is shown therein that, while the light fraction can be satisfactorily treated in two steps, the first one at a temperature less than 260° C., and the second one at a temperature in excess of 260° C., the additional presence of the heavy fraction results in a deleterious degree of copolymerization with the unsaturated hydrocarbons of the light fraction. It is then proposed to hydrogenate the heavy fraction in a prior step, named the first step, before admixing with the light fraction, the resulting mixture being then treated according to the above two steps, named the second and third steps. The overall effect is to saturate the diolefins and olefins and to remove various contaminants, while the aromatic hydrocarbons are not converted and can be recovered thereafter.

Two essential conditions of the above process are a temperature below 260° C. in the first and second steps of the process and the absence of halogen in the catalysts. A preferred catalyst comprises molybdenum and an iron-group metal, although any known catalyst may be used.

A process for hydrogenating aromatic hydrocarbons with a group VIII noble metal catalyst is known from U.S. Pat. No. 3,954,601.

Attempts to apply this process to a heavy fraction previously hydrogenated in two steps with a cobalt molybdenum catalyst, under the conditions of U.S. Pat. No. 3,161,586 have proved unsatisfactory in relation to both the degree of hydrogenation of the aromatic hydrocarbons and the utilization of the noble metal catalyst over extended periods.

The process of the present invention has for its main object treating hydrocarbon fractions corresponding roughly to the heavy fraction as defined above, not only to hydrogenate diolefins and monoolefins and to remove the contaminants, but also to hydrogenate the aromatic hydrocarbons which are detrimental to certain uses of the products, for example as jet or Diesel fuels. Another object is the ability to operate over long periods without deactivation of the catalysts.

It has now been found that, when treating relatively heavy hydrocarbon feeds, only a particular choice of catalysts and operating conditions allows the above objects to be achieved without deactivation of the catalysts. In particular, when using a cobalt-molybdenum catalyst in the initial steps of the process, insufficient hydrogenation and rapid deactivation of the catalysts are observed.

The process which is the object of the present invention comprises a treatment of the charge in three successive hydrotreatment steps having each a determined hydrogenation level, and the use of specific catalysts. One object of the first step (H1) is to hydrogenate the most unstable components of the charge, i.e. the hydrocarbons of indenio and alkenylaromatic types. The presence of these compounds is analytically determined by reaction with bromine and maleic anhydride. Bromine numbers (ASTM standard 1159-17) up to 50 or even 100 or more (g/100 g) and maleic anhydride values (UOP standard 326-65) up to 50 or even 100 or more (mg/g) have been thus observed. This first step has, as the main object, the yielding of products whose bromine number (Br I) is lower than 10 and maleic anhydride value (MAV) lower than 5. Useful operating conditions of this first treatment are as follows:

pressure: 10 to 100 bars and preferably 20 to 60 bars.
space velocity (volume of feed per volume of catalyst and per hour — V.V.H.): 0.3 to 5 and preferably from 0.5 to 2.
temperature: 100° to 250° C., preferably 150°-225° C.
hydrogen to hydrocarbon ratio ($H_2$/HC): 50 to 1,000 NTP liters/liter and preferably 100 to 500 liters/-liter.

Catalysts to be used in this first operation consist of group VIII metals, for example nickel, platinum or palladium deposited on or incorporated to an inert carrier in any convenient manner. These catalysts operate essentially in the reduced metal state, at least at the beginning of the operation.

The nickel content is, for example, 1-30% b.w. and the platinum content, for example, 0.1-2% by weight. Palladium catalysts are however preferred, as they behave more satisfactorily; the palladium content is preferably 0.1-2% by weight.

Preferred carriers are silica or alumina of low acidity. A particularly well-adapted alumina carrier of low (or nil) acidity has a neutralization heat by ammonia absorption preferably lower than 10 calories, particularly lower than 7 calories per gram of alumina at 320° C. under 300 mm mercury pressure.

The acidity of the catalyst may be determined according to the known ammonia absorption test, such as described, for example, in Journal of Catalysis, 2, 212-222 (1963): the method consists of heating the catalyst up to 600° C. in vacuo (i.e. at a pressure lower than about 0.01 mm mercury) up to total removal of gas (this, in particular, to remove water and undesired impurities); the catalyst is then introduced into a calorimeter at 320° C. and ammonia is supplied in such an amount that the final pressure of the balanced system is 300 mm mercury; the amount of heat released is measured.

Alumina, the preferred carrier, may also be characterized by its resistance to cracking and coking in the presence of hydrogen. Testing for such resistance may be effected in any convenient manner. As an example of a test, there is cracked an easily crackable molecule such as n-heptane. Alumina is considered as inert if n-heptane, injected at 500° C. at a space velocity of 1 over the carrier arranged as a fixed bed in a reactor at a hydrogen pressure of 20 bars and a hydrogen feed rate of 4 moles per mole of n-heptane, is collected at the outlet of the reactor at a rate of at least 99% by weight with respect to the supplied amount.

Aluminas complying with this specification are, for example, those obtained by calcining tetragonal boehmite, aluminas impregnated with nickel or cobalt and then treated at high temperature according to the French Patent No. 2,118,309, aluminas treated with alkali and earth-alkaline metals of groups I and II, etc. Physical properties of these carriers are preferably: specific surface from 10 to 300 $m^2/g$, preferably 40 to 200 $m^2/g$, total pore volume from 0.1 to 1 cc/g, preferably 0.3 to 0.8 cc/g, average pore diameter from 50 to 1,000 Å, preferably 80 to 500 Å.

The first step catalyst may be manufactured according to known methods, for example, by admixing a nickel and/or palladium compound with an alumina carrier, shaping the catalyst, if necessary, and calcining at for example, 300°-600° C. in the air. The catalyst is finally reduced to the metal state, for example with hydrogen at 50°-500° C. Examples of compounds are nickel nitrate, nickel acetate, palladium chloride and palladium nitrate.

The product obtained at the outlet of the first hydrogenation stage is then supplied to a second hydrotreatment unit (H2). A main object of this step is to selectively reduce the sulfur content of the feed down to 5 to 200 ppm, preferably 10 to 100 ppm by weight. Partial hydrogenation of the aromatic hydrocarbons may also take place (for example up to about 10% hydrogenation). The operating conditions of this treatment are usually the following:

pressure: 10 to 150 bars, preferably 30 to 100 bars.
space velocity (VVH): 0.25 to 5, preferably 0.5 to 2.
temperature: 250° to 400° C., preferably 300° to 380° C.
$H_2$/HC ratio: 100 to 1,000 liters/liter, preferably 200 to 600 liters/liter.

The catalyst is a hydrodesulfurization/hydrogenation catalyst comprising both at least one tungsten compound and at least one nickel compound.

Catalysts comprising only cobalt and molybdenum compounds are not satisfactory for the first and second steps of the process since the effluent products cannot be satisfactorily treated over long periods in the third step of the present process, i.e., the final product has a too high aromatic content and the catalysts deactivate quickly.

The preferred tungsten and nickel compounds in the second step catalyst are the sulfides. The catalysts can be manufactured according to methods known in the art, for example by admixing alumina with one or more compounds of the above metals, either in the dry state or as solutions. The mixture is shaped, if necessary, and may be calcined, for example at 250°-650° C. in the air. Suitable compounds include ammonium tungstate, nickel nitrate, nickel citrate, nickel acetate, etc.

A subsequent treatment with hydrogen sulfide or with an organic sulfur compound may then take place to convert the catalyst to the sulfided form. A mixture of, for example, 0.5-10% $H_2S$ by volume with 90-99.5% $H_2$ is preferred. The sulfiding treatment may take place at, for example, 250°-450° C. Direct sulfiding with the hydrocarbon charge may also occur.

When using alumina of, for example, one of the above types, the tungsten content of the catalyst is usually 5-40% by weight, calculated as $WO_3$, and the nickel content may range from 2 to 20% by weight, calculated as NiO.

The catalyst of the second step of the process is thus distinguished over the catalyst of the first step which operates mainly in the reduced metal state, although limited (selective) sulfur adsorption may take place on the latter in the course of the process.

According to a preferred embodiment, the second step of the process is conducted by passing the hydrocarbon charge with hydrogen over two successive catalysts.

The first catalyst contains at least one nickel compound and at least one tungsten compound incorporated to/or deposited on an alumina carrier; the ratio $$R = Ni/W,$$

where the metal proportions are in gram-atoms of metals, is 1.5:1 to 10:1, preferably 2:1 to 5:1.

The second catalyst, which is placed after the first one, also contains at least one nickel compound and at least one tungsten compound incorporated to/or deposited on an alumina carrier; the ratio $$R = Ni/W,$$

where the metal proportions are as stated above, is 0.1:1 to 1:1, preferably 0.25:1 to 0.6:1.

These two catalysts are preferably present in the same reactor, behind each other. The carrier of the first catalyst is preferably an alumina of low acidity, as used for the catalyst of the first step. The carrier of the second catalyst may be equivalent, although a moderate acidity of the carrier may be tolerated.

The product of the second step is substantially free of sulfur and nitrogen (it preferably contains 10–100 ppm by weight of sulfur); it may also contain up to 90% by weight of aromatic compounds, although the aromatic hydrocarbon content has usually substantially decreased.

A main object of the third step ($H_3$) is to almost completely hydrogenate the aromatic compounds, i.e. to such an extent that their maximal content be, for example, 20% by weight and if necessary, as low as 1% by weight. The resulting product is thus mainly composed of compounds of the naphthenic type. Useful operating conditions for this third step are the following:

pressure: 10 to 100 and preferably 30 to 80 bars.
space velocity (VVH): 0.5 to 6 and preferably 1 to 4.
temperature: 200° to 380° C. and preferably 250 to 330° C.
$H_2$/HC ratio: 500 to 2,000 liters/liter and preferably 600 to 1,500 liters/liter.

The catalyst of the latter step contains at least one noble metal from group VIII carried on alumina. It contains 0.1–2% by weight of noble metal of group VIII, preferably platinum, and 0.5–15% by weight of chlorine or fluorine (preferably 1 to 5%). A catalyst particularly well-adapted to the feed charges of the invention is selected from those disclosed in the U.S. Patent 3,954,601 whose disclosure is incorporated herein by way of reference. According to this patent, it is obtained by incorporating to an aluminous carrier a compound of a group VIII noble metal and an organometallic reducing agent of the general formula $Al\ X_y\ R_{3-y}$ where $y$ may be 1, 3/2 or 2; X is halogen, for example F or Cl, preferably Cl, and R is a monovalent hydrocarbon radical.

The reducing agent may be a well-defined single compound or a mixture of several compounds, for example ethyl aluminum sesquichloride of the analytical formula $Al_2\ Cl_3\ (C_2\ H_5)_3$ or $Al_2\ Cl_{3/2}\ (C_2\ H_5)_{3/2}$.

The catalyst of the third step may also be manufactured from a Group VIII metal compound, hydrochloric acid and alumina, according to well-known methods. Reduction of the calcined catalyst with hydrogen occurs as the final step of the manufacture.

The preferred carrier is alumina of a specific surface from 50 to 500 $m^2/g$. The total pore volume will be advantageously from 0.1 to 1 cc/g. The noble metals may be, for example, Pt, Ir, Rh or Ru, preferably Pt and/or Ir as salts or complexes soluble in organic solvents. Salts may be used, for example, halides, alcoholates, acetylacetonates and carboxylates, or complexes, for example complexes with carbon monoxide or ammonia.

EXAMPLE 1 (comparison)

This example illustrates the use of a known technique wherein a single hydrotreatment catalyst is employed. In this example, the starting material is a steam-cracking heavy fraction boiling for more than 95% over 200° C. and whose main characteristics are as follows:

$d_4^{15} = 0.972$
S = 710 ppm b.w.
N = 115 ppm b.w.
Aromatics by sulfonation = 100% by volume
Bromine number = 38 g/100 g
MAV = 40 mg/g
Distillation ASTM ° C.
IP = 168
5% = 209
10% = 211
50% = 231
90% = 255
FP = 291

The catalyst employed for the hydrotreatment of this charge comprises nickel oxide and tungsten oxide in a proportion of 3.4% b.w. NiO and 24.7% b.w. $WO_3$ admixed with alumina gel.

The metal elements are introduced in a conventional manner by kneading, in the presence of water, the alumina gel with the desired proportions of nickel nitrate and ammonium metatungstate. The resulting paste is extruded and then calcined in the air at about 550° C., so as to yield the corresponding nickel and tungsten oxides. Another satisfactory method comprises impregnating previously shaped alumina with aqueous solutions of salts of the catalytic metals, followed with calcining as above.

The physico-chemical characteristics of the catalyst are:

shape: extrudates of 1.5 mm diameter
filling density: 0.81 g/cc
total pore volume: 0.43 cc/g
specific surface: 183 $m^2/g$.

Before use, the catalyst is treated for 5 hours with 2% hydrogen sulfide by volume in hydrogen at 350° C. and substantially atmospheric pressure.

The operating conditions for hydrotreatment are the following:

Reactor pressure: 100 bars
Space velocity: 0.5 kg of hydrocarbon charge/kg of catalyst/hour
Hydrogen recycle: 1,000 liters (NTP) per liter of charge
Temperature: variable during the experiment.

The results of this experiment are reported in the following table, given as a function of the run time, are:

the temperature at the bed inlet
the content of saturated hydrocarbons in the product
the pressure drop within the reactor (ΔP).

| HOURS OF RUN | 125 | 250 | 500 | 750 | 1,000 | 1,240 |
|---|---|---|---|---|---|---|
| T° C. at the inlet of the catalyst bed | 323 | 325 | 326 | 327 | 328 | 330 |

-continued

| HOURS OF RUN | 125 | 250 | 500 | 750 | 1,000 | 1,240 |
|---|---|---|---|---|---|---|
| % b.w. of saturated hydrocarbons in the product* | 52 | 50,5 | 51,5 | 49 | 51 | 51.5 |
| ΔP reactor (bars) | 1,2 | 1,6 | 2.4 | 3.6 | 5.7 | 10.1 |

*The remainder consists of aromatic hydrocarbons.

EXAMPLE 2 (comparison)

The same material as treated in example 1 is subjected to a hydrotreatment step ($H_2$) comprising two successive catalysts.

The first catalyst (CATA A) to be used at the inlet of the reactor is prepared as follows: 10% b.w. of NiO and 10% b.w. of $WO_3$ are incorporated to an alumina carrier by impregnation with a mixture in aqueous solution of nickel nitrate and ammonium metatungstate, said alumina carrier having a specific surface of 190 $m^2/g$, a total pore volume of 0.6 cc/g and an acidity, determined by ammonia absorption, according to the above described method, of 5 calories per gram. The resulting catalyst is then dried and calcined in an air stream at 550° C. for 2 hours.

The second catalyst (CATA B) is placed behind CATA A in the reactor; it is the same catalyst as used in example 1.

Both catalysts are sulfided before use as disclosed in example 1.

The physico-chemical properties of catalyst A are:
shape: 3 to 5 mm balls
filling density: 0.80 g/cc
total pore volume: 0.45 cc/g
specific surface: 150 $m^2/g$.

The ratio by weight of CATA B to CATA A is 4/1.

The operating conditions are identical to those of experiment 1; the results of the experiment are reported in the following table, in relation to the run time.

| HOURS OF RUN | 125 | 250 | 500 | 1,000 | 1,500 | 2,000 | 2,450 |
|---|---|---|---|---|---|---|---|
| T° C.at the inlet of the catalyst bed A | 305 | 307 | 315 | 320 | 323 | 326 | 330 |
| T° C.at the inlet of the catalyst bed B | 335 | 336 | 335 | 337 | 338 | 340 | 343 |
| % b.w. of saturated hydrocarbons in the product* | 50,5 | 51 | 51 | 50.5 | 51.5 | 52 | 51 |
| ΔP reactor (bars) | 1,1 | 1.1 | 1.2 | 1.8 | 2.9 | 5.5 | 10.0 |

*The remainder consists of aromatic hydrocarbons.

EXAMPLE 3 (comparison)

The same material as treated in examples 1 and 2 is subjected, in this example, to two successive hydrotreatment steps.

The catalyst employed in the first hydrotreatment step ($H_1$) is prepared as described in the French Pat. No. 2,070,995.

This catalyst is made of 0.30% b.w. reduced palladium metal deposited from palladium nitrate on an alumina of low acidity such as hereinafter described, followed with calcining at 450° C. and hydrogen reduction at 100° C.

The physico-chemical characteristics of this catalyst are the following:
shape: 2 to 4 mm balls
filling density: 0.70 g/cc
total pore volume: 0.60 cc/g
specific surface: 71 $m^2/g$ The operating conditions for the first step are the following:
reactor pressure: 40 bars
space velocity: 1 kg charge/kg catalyst/hour
hydrogen recycle: 200 liters (NTP)/liter of charge
temperature: 200° C.

The product of this first step is treated in a second step ($H_2$) such as described in example 2, under the following conditions:
reactor pressure: 100 bars
space velocity: 0.5 kg charge/kg catalyst/hour
hydrogen recycle: 1,000 liters (NPT)/liter of charge
inlet temperature, catalyst A: 320° C.
inlet temperature, catalyst B: 340° C.
weight of CATA B/weight of CATA A: 4/1.

The results are given in the following table:

| HOURS OF RUN | 125 | 250 | 500 | 1,000 | 2,000 | 3,000 |
|---|---|---|---|---|---|---|
| BrI product ($H_1$) | 5 | 5.5 | 4 | 6 | 6 | 6 |
| MAV product ($H_1$) | 0 | 1 | 0.5 | 1.5 | 1.3 | 1.8 |
| ΔP reactor ($H_1$) (bars) | 0.4 | 0.4 | 0.4 | 0.5 | 0.8 | 1.7 |
| % b.w. of saturated hydrocarbons in the product ($H_2$)* | 49 | 49.5 | 50.5 | 50 | 51 | 50.5 |
| ΔP reactor ($H_2$) (bars) | 1.1 | 1 | 1.1 | 1.1 | 1.2 | 1.1 |

*The remainder consists of aromatic hydrocarbons.

After 3,000 hours of run, the operating conditions of $H_2$ have been changed to:
reactor pressure: 60 bars
space volocity: 1 kg charge/kg cata/hour
hydrogen recycle: 500 liters (NTP)/liter of charge
temperature at the inlet of catalyst bed A: 320° C.
temperature at the inlet of catalyst bed B: 340° C.

After 250 hours of run at these conditions, the following results have been obtained:
BrI product ($H_1$): 7.2
MAV product ($H_1$): 2
ΔP reactor $H_1$ (bars): 2.1
% b.w. of saturated hydrocarbons in the product ($H_2$): 15
% b.w. of aromatic hydrocarbons in the product ($H_2$): 85
sulfur in the product ($H_2$): 33 ppm by weight.

After 250 hours of run at the above conditions, i.e. after a total run of 3,250 hours, the operating conditions of $H_2$ are changed to:
reactor pressure: 125 bars
space velocity: 0.25 kg charge/kg cata/hour
hydrogen recycle: 1,500 liters (NTP) /liter of charge
temperature at the inlet of the catalyst bed A: 330° C.
temperature at the inlet of the catalyst bed B: 350° C.

After 500 hours of run at these conditions, the following results have been obtained:
BrI product ($H_1$): 9
MAV product ($H_1$): 3
ΔP reactor $H_1$ (bars): 3
% b.w. of aromatic hydrocarbons in the product ($H_2$): 17 (the remainder consists of saturated hydrocarbons)
sulfur in the product ($H_2$): <5 ppm by weight.

The results obtained in the experiments of example 3 show:
(1) that the association $H_1 + H_2$ yields increased running times with acceptable pressure drops in the reactors.
(2) that it is very difficult, even under very severe operating conditions, to obtain a product having a very low content of aromatic hydrocarbons.

(3) that it is conversely easy to obtain a desulfurized product.

EXAMPLE 4 (comparison)

The material treated in example 1 is now subjected to a hydrotreatment step of the $H_3$ type. The catalyst is prepared in the same manner as catalyst $C_3$ Al Cl of U.S. Pat. No. 3,954,601. The catalyst consists of 0.6% b.w. platinum and 1.5% b.w. fluorine on δ cubic transition alumina; the physico-chemical characteristics of this catalyst are:

shape: extrudates of 1.5 mm diameter
filling density: 0.65 g/cc
total pore volume: 0.51 cc/g
specific surface: 180 $m^2/g$ The operating conditions are the following:

reactor pressure: 55 bars
space velocity: 2.2 kg of charge/kg of catalyst/hour
hydrogen recycle: 1,200 liters (NTP)/liter of charge
inlet temperature: 300° C.

After 100 hours of run, the product has the following properties:

$d_4^{15}$: 0.960
BrI: 1
MAV: 0
% by weight of aromatic hydrocarbons in the product: 90

This example shows that $H_3$, when used alone, does not provide for the desired hydrogenation of the starting material.

EXAMPLE 5

In this example, the starting material of example 1 has been treated in the three successive steps $H_1$, $H_2$, $H_3$ according to the process of the invention. The catalysts of these three steps were those described in example 3 for $H_1$, example 2 for $H_2$ and example 4 $H_3$. The operating conditions are given in the following table:

| | $H_1$ | $H_2$ | $H_3$ |
|---|---|---|---|
| Reactor pressure (bars) | 30 | 60 | 70 |
| Space velocity kg/kg cata/hour | 1 | 1 | 2.2 |
| Hydrogen recycle liters NTP/liter | 200 | 500 | 1,200 |
| Inlet temperature ° C. | 200 | CATA A = 320<br>CATA B = 340 | 300 |

The characteristics of the final product after 1,000 hours and 3,000 hours of run are given below:

| | 1,000 hours | 3,000 hours |
|---|---|---|
| $d_4^{15}$ | 0.861 | 0.860 |
| BrI | 0.1 | 0.1 |
| MAV | 0 | 0 |
| % b.w. of aromatic hydrocarbons (the remainder consists of saturated hydrocarbons) | 2.2 | 2.5 |
| sulfur content ppm by weight | <1 | <1 |

The pressure drop (in bars) within the catalyst beds was determined after 250 and 750 hours. The results were:

| | 250 hours | 750 hours |
|---|---|---|
| first catalyst bed | 0.40 | 0.45 |
| second catalyst bed | 1.1 | 1.1 |
| third catalyst bed | 0.5 | 0.6 |

These figures show negligible clogging of the three beds.

Example 5 has been repeated successfully with analogous charges whose bromine number was 10 to 50 or more and MAV 5 to 50 or more.

EXAMPLE 6

Example 5 was repeated, except that the double catalyst bed of step $H_2$ was changed for one single catalyst bed: that of example 1.

The operating conditions were those disclosed in example 5, except that the inlet temperature of the single sulfided catalyst bed of step $H_2$ was 315° C.

The results after 1,000 hours of run were:

| | |
|---|---|
| $d_4^{15}$ | 0.862 |
| BrI | 0.1 |
| MAV | 0 |
| % b.w. of aromatic hydrocarbons (the remainder consists essentially of saturated hydrocarbons) | 2.3 |
| sulfur content ppm by weight | <1 |

The pressure drop (in bars) through the catalyst beds has been determined as above with the following results:

| | 250 hours | 750 hours |
|---|---|---|
| First catalyst bed | 0.40 | 0.45 |
| Second catalyst bed | 1.1 | 1.7 |
| Third catalyst bed | 0.55 | 0.7 |

EXAMPLE 7

Example 5 has been repeated, except that the catalyst of the first step ($H_1$) was changed for a 10% b.w. nickel-on-alumina catalyst prepared as follows: alumina was impregnated with nickel nitrate and the resulting agglomerates were heated for 2 hours at 550° C. in the air, then reduced with hydrogen at 1 bar pressure at 400° C. for 15 hours. The conditions were those of example 5, except the pressure of $H_1$ which was increased to 60 bars and the hydrogen recycle of $H_1$ which was 500 NTP per liter.

The results were substantially identical to those of example 5, both as concerns the characteristics of the final product and the pressure drop in the reactors.

EXAMPLE 8 (comparison)

Example 5 was repeated, except that the catalysts of steps $H_1$ and $H_2$ were both changed for a presulfided alumina catalyst containing 2.2% b.w. of cobalt and 5.7% b.w. of molybdenum, the operating conditions for said steps being substantially those of U.S. Pat. No. 3,161,586.

The operating conditions were:

| | $H_1$ | $H_2$ | $H_3$ |
|---|---|---|---|
| Reactor pressure (bars) | 60 | 60 | 70 |
| Space velocity kg/kg cata/hour | 1 | 1 | 2.2 |
| Hydrogen recycle liters NTP/liter | 500 | 500 | 1.200 |

-continued

| | $H_1$ | $H_2$ | $H_3$ |
|---|---|---|---|
| Inlet temperature ° C. | 200 | 315 | 300 |

The characteristics of the final product after 250 and 750 hours were:

| | 250 hours | 750 hours |
|---|---|---|
| $d_4^{15}$ | 0.867 | 0.868 |
| BrI | 0.1 | 0.1 |
| MAV | 0 | 0 |
| % b.w. of aromatic hydrocarbons (the remainder consists of saturated hydrocarbons) | 6 | 10.5 |
| sulfur content (ppm by weight) | <1 | <1 |
| Pressure drop (bars) | | |
| First catalyst bed | 2 | 4.5 |
| Second catalyst bed | 1.2 | 2.5 |
| Third catalyst bed | 0.6 | 1.1 |

A comparison of the results obtained in the examples 5, 6 and 8 shows that the arrangement of example 8 does not yield thoroughly hydrogenated products and that the catalysts are rapidly poisoned.

What we claim is:

1. A process for the substantially complete hydrogenation of an unstable hydrocarbon fraction obtained by pyrolysis, whose boiling range is at least in major part over 200° C. and which comprises more than 80% b.w. of aromatic hydrocarbons and more than 0.01% b.w. of sulfur, which comprises the successive steps of:

(a) passing the unstable hydrocarbon fraction with hydrogen in contact with a catalyst comprising a group VIII metal in the metal state at a temperature of 100° to 250° C.;

(b) treating the product of step (a) with hydrogen in contact with a catalyst comprising at least one tungsten compound and at least one nickel compound, at a temperature of 250° to 400° C.;

(c) treating the product of step (b) with hydrogen at 200°–380° C. in contact with a catalyst consisting essentially of 0.1–2% b.w. of at least one group VIII noble metal, 0.5–15% b.w. of chlorine or fluorine and alumina, and collecting a hydrogenated and stabilized hydrocarbon fraction.

2. A process according to claim 1, wherein the temperature of step (b) is 300°–380° C.

3. A process according to claim 1, wherein the catalyst of step (c) is the product resulting from the treatment of a platinum/alumina catalyst with a compound of the formula $Al\ X_y\ R_{3-y}$ where $y$ is 1, 1.5 or 2, X is fluorine or chlorine and R is a monovalent hydrocarbon radical.

4. A process according to claim 1, wherein the conditions of step (b) are so selected as to reduce the sulfur content to 5–200 ppm by weight.

5. A process according to claim 1, wherein, during step (b), the hydrocarbon charge and hydrogen are passed in contact with two catalysts both comprising alumina, at least one nickel compound and at least one tungsten compound, the atomic ratio Ni/W being from 1.5:1 to 10:1 for the first catalyst and 0.1:1 to 1:1 for the second catalyst.

6. A process according to claim 1, wherein the unstable hydrocarbon fraction contains 0–10% b.w. of saturated hydrocarbons and 90–100% b.w. of aromatic hydrocarbons.

7. A process according to claim 1, wherein the catalyst of step (a) consists essentially of 0.1–2% b.w. of palladium metal on alumina.

8. A process according to claim 1, wherein the contact of step (c) is so maintained as to obtain a product containing less than 10% b.w. of aromatic hydrocarbons.

9. A process according to claim 1, wherein the catalyst of step (c) contains 1–5% b.w. of chlorine or fluorine.

10. A process according to claim 1, wherein the unstable hydrocarbon fraction has a bromine number from 10 to 50 and a maleic anhydride value from 5 to 50.

11. A process according to claim 1, wherein the temperature is 150°–225° C. for step (a), 300°–380° C. for step (b) and 250°–330° C. for step (c).

12. A process according to claim 1, wherein the catalyst of step (b) is a sulfided nickel-tungsten-on-alumina catalyst, the proportions of nickel and tungsten being respectively 2–20% and 5–40% b.w., as expressed as oxide.

13. A process according to claim 5, wherein the two catalysts are each sulfided nickel-tungsten-on-alumina catalysts, the proportions of nickel and tungsten being respectively 2–20% and 5–40% b.w., as expressed as oxide.

14. A process according to claim 1, wherein the unstable hydrocarbon fraction has an initial boiling point above 150° C.

* * * * *